US009261275B2

(12) United States Patent
Decker

(10) Patent No.: US 9,261,275 B2
(45) **Date of Patent: *Feb. 16, 2016**

(54) CANDLE HAVING A PLANAR WICK AND METHOD OF AND EQUIPMENT FOR MAKING SAME

(75) Inventor: DayNa M. Decker, Studio City, CA (US)

(73) Assignee: LUMETIQUE, INC., Studio City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/848,543

(22) Filed: Aug. 2, 2010

(65) Prior Publication Data

US 2011/0027737 A1 Feb. 3, 2011

Related U.S. Application Data

(63) Continuation of application No. 10/759,508, filed on Jan. 15, 2004, now Pat. No. 8,348,662, which is a continuation-in-part of application No. 10/300,695, filed on Nov. 19, 2002, now abandoned.

(60) Provisional application No. 60/331,898, filed on Nov. 19, 2001.

(51) Int. Cl.
*F23D 3/16* (2006.01)
*F23D 3/18* (2006.01)

(52) U.S. Cl.
CPC ..... *F23D 3/16* (2013.01)

(58) Field of Classification Search
USPC ..... 431/288, 289, 298, 325, 291
See application file for complete search history.

(56) References Cited

U.S. PATENT DOCUMENTS

| | | | | | |
|---|---|---|---|---|---|
| 52,231 | A | * | 1/1866 | Walton | 431/325 |
| 59,839 | A | * | 11/1866 | Hoard | 431/298 |
| 123,917 | A | | 2/1872 | Ladd | |
| 170,158 | A | | 11/1875 | Cushing | |

(Continued)

FOREIGN PATENT DOCUMENTS

| | | |
|---|---|---|
| EP | 1245663 | * 10/2002 |
| FR | 2639356 | * 5/1990 |

(Continued)

OTHER PUBLICATIONS

Firewood for Your Fireplace, Warren Donnelly, pp. 17,18,25,34,35,37, 88-95, May 1974, Library of Congress Card No. 74-76012.*

(Continued)

*Primary Examiner* — Avinash Savani
*Assistant Examiner* — Vivek Shirsat
(74) *Attorney, Agent, or Firm* — Oblon, McClelland, Maier & Neustadt, L.L.P.

(57) ABSTRACT

A candle having a body of a meltable fuel and a planar wick. When lit, the candle provides a unique flame formation, usable in a variety of decorative applications. The wick can be configured to evenly deplete the meltable fuel, while allowing for candles having relatively large and unique body configurations. The body of candle and/or the wick may include scented oil to promote the release of fragrance upon heating. The wick preferably is formed of wood, thereby providing an acoustic contribution to ambiance and improved combustion that generates less soot than conventional cotton wick candles.

30 Claims, 9 Drawing Sheets

(56) References Cited

U.S. PATENT DOCUMENTS

| | | | | | |
|---|---|---|---|---|---|
| 197,902 | A | * | 12/1877 | Scott | 431/325 |
| 252,590 | A | | 1/1882 | Loper | |
| 275,293 | A | | 4/1883 | Tisdale | |
| 323,058 | A | | 7/1885 | Mitchell | |
| 383,822 | A | * | 5/1888 | Munger | 431/325 |
| 415,231 | A | | 11/1889 | Walters | |
| 431,033 | A | * | 7/1890 | Chapin | 431/325 |
| 436,509 | A | | 9/1890 | Walters | |
| 827,066 | A | | 7/1906 | Hafner | |
| 1,267,968 | A | * | 5/1918 | Bulle | 431/291 |
| 1,320,109 | A | * | 10/1919 | Wooster | 431/291 |
| 1,389,490 | A | * | 8/1921 | Cook et al. | 431/120 |
| 1,475,134 | A | * | 11/1923 | Oakes | 248/468 |
| 1,576,205 | A | | 3/1926 | Mertens | |
| 1,636,709 | A | | 7/1927 | Schmidt | |
| 1,657,391 | A | | 1/1928 | Haney | |
| 1,660,760 | A | | 2/1928 | Murphy | |
| 1,756,885 | A | * | 4/1930 | Schafer | 248/468 |
| 1,831,902 | A | | 11/1931 | Brown | |
| 1,841,690 | A | * | 1/1932 | Weindel, Jr. | 248/453 |
| 1,961,920 | A | | 6/1934 | Arpin | |
| 2,015,383 | A | | 9/1935 | Konig et al. | |
| 2,107,054 | A | | 2/1938 | Haymond | |
| 2,168,698 | A | * | 8/1939 | Bunt et al. | 431/291 |
| 2,241,167 | A | | 5/1941 | Storck | |
| 2,324,753 | A | * | 7/1943 | Alexiade | 431/323 |
| 2,373,512 | A | | 4/1945 | Starner | |
| 2,464,361 | A | | 3/1949 | Wilson | |
| 2,758,460 | A | * | 8/1956 | Ciano | 431/298 |
| 2,809,512 | A | | 10/1957 | Hartnett | |
| 3,039,283 | A | | 6/1962 | Buscemi | |
| 3,086,658 | A | * | 4/1963 | Palmer | 211/50 |
| 3,175,876 | A | * | 3/1965 | Fredericks | 422/126 |
| 3,286,492 | A | | 11/1966 | Frazier, Jr. | |
| 3,367,758 | A | | 2/1968 | Ambrose et al. | |
| 3,380,797 | A | | 4/1968 | Summers | |
| 3,428,409 | A | | 2/1969 | Summers | |
| 3,462,235 | A | | 8/1969 | Summers | |
| 3,466,135 | A | | 9/1969 | Summers | |
| 3,560,122 | A | | 2/1971 | Cassar | |
| 3,637,335 | A | * | 1/1972 | Uhl | 431/291 |
| 3,706,523 | A | | 12/1972 | Kumm | |
| 3,759,478 | A | | 9/1973 | Schmitt et al. | |
| 3,761,702 | A | * | 9/1973 | Andeweg | 362/161 |
| 3,883,143 | A | * | 5/1975 | Kelley et al. | 273/246 |
| 3,998,922 | A | * | 12/1976 | Weiss | 264/255 |
| 4,304,547 | A | | 12/1981 | Buzil | |
| 4,381,914 | A | | 5/1983 | Ferguson | |
| 4,477,249 | A | | 10/1984 | Ruzek et al. | |
| 4,557,687 | A | * | 12/1985 | Schirneker | 431/291 |
| 4,568,269 | A | | 2/1986 | Lin | |
| 4,568,270 | A | | 2/1986 | Marcus et al. | |
| 4,682,947 | A | | 7/1987 | Luken, Jr. | |
| 4,696,640 | A | | 9/1987 | Pitchford | |
| 4,725,286 | A | | 2/1988 | Brame | |
| 4,804,323 | A | | 2/1989 | Kim | |
| 4,839,144 | A | * | 6/1989 | Martin | 422/305 |
| 4,855,098 | A | | 8/1989 | Taylor | |
| 4,917,597 | A | | 4/1990 | Henze | |
| 5,015,175 | A | | 5/1991 | Lee | |
| 5,069,617 | A | | 12/1991 | Lin | |
| D350,566 | S | * | 9/1994 | Pearson | D20/40 |
| 5,363,590 | A | | 11/1994 | Lee | |
| 5,487,658 | A | | 1/1996 | Lee | |
| 5,597,300 | A | | 1/1997 | Wohl et al. | |
| 5,683,239 | A | | 11/1997 | Cardosi | |
| 5,683,762 | A | | 11/1997 | Banschick | |
| 5,762,487 | A | * | 6/1998 | Kujawski | 431/289 |
| 5,772,424 | A | | 6/1998 | Nokelainen | |
| 5,807,096 | A | | 9/1998 | Shin et al. | |
| 5,830,245 | A | | 11/1998 | Raddon | |
| 5,846,070 | A | | 12/1998 | Kim et al. | |
| 5,879,153 | A | | 3/1999 | Slejertin | |
| 5,967,769 | A | | 10/1999 | Thompson | |
| 6,017,373 | A | * | 1/2000 | Frisch | 44/535 |
| 6,033,210 | A | | 3/2000 | Freeman | |
| 6,062,847 | A | * | 5/2000 | Pappas | 431/35 |
| 6,063,144 | A | | 5/2000 | Calzada et al. | |
| 6,068,472 | A | | 5/2000 | Freeman et al. | |
| 6,074,199 | A | | 6/2000 | Song | |
| 6,076,515 | A | | 6/2000 | Smith | |
| 6,129,771 | A | | 10/2000 | Ficke | |
| 6,214,295 | B1 | | 4/2001 | Freeman | |
| 6,241,512 | B1 | | 6/2001 | Freeman et al. | |
| 6,276,925 | B1 | | 8/2001 | Varga | |
| 6,405,441 | B1 | * | 6/2002 | Rucker | 30/179 |
| 6,409,501 | B1 | | 6/2002 | Pappas | |
| 6,419,713 | B1 | | 7/2002 | Durand et al. | |
| 6,440,184 | B2 | | 8/2002 | Noda et al. | |
| 6,454,561 | B1 | * | 9/2002 | Colthar et al. | 431/289 |
| 6,471,899 | B2 | | 10/2002 | Daiber et al. | |
| 6,508,644 | B1 | * | 1/2003 | Pesu et al. | 431/35 |
| 6,554,448 | B2 | | 4/2003 | Carpenter | |
| 6,568,934 | B1 | | 5/2003 | Butler | |
| 6,783,356 | B2 | | 8/2004 | Hermanson | |
| 6,793,484 | B2 | * | 9/2004 | Pesu et al. | 431/35 |
| 6,793,697 | B2 | | 9/2004 | Sprules et al. | |
| 6,823,780 | B2 | | 11/2004 | Vogt et al. | |
| 6,863,525 | B2 | * | 3/2005 | Byrd | 431/35 |
| 7,568,913 | B2 | * | 8/2009 | Decker et al. | 431/325 |
| 2001/0029003 | A1 | | 10/2001 | Zou | |
| 2001/0043469 | A1 | | 11/2001 | Carpenter et al. | |
| 2002/0018976 | A1 | | 2/2002 | Zou | |
| 2002/0022205 | A1 | * | 2/2002 | Elliott et al. | 431/35 |
| 2003/0036028 | A1 | | 2/2003 | Pesu et al. | |
| 2004/0029061 | A1 | * | 2/2004 | Dibnah et al. | 431/291 |
| 2004/0033463 | A1 | * | 2/2004 | Pesu et al. | 431/289 |
| 2005/0037308 | A1 | | 2/2005 | Decker | |

FOREIGN PATENT DOCUMENTS

| | | | |
|---|---|---|---|
| FR | 2811676 | * | 1/2002 |
| SE | 9903818 | * | 5/2000 |

OTHER PUBLICATIONS

Swedish Patent: SE 9903818, "Outdoor Candle", Ebeling, Oct. 1999 (English Language Translation), 1-8 pages.*

Firewood for Your Fireplace; Warren Donnelly; Oct. 1974; pp. 18,25,34,35,37,84,85,88-95.

Swedish U.S. Pat. No. 9903818; English language translation; Gunnar Ebeling; May 2, 2000; pp. 1a-7.

www.CLARLUSSP.com/candles/index.php, "Waxes: Candles." Internet printout on Jul. 6, 2006, 1 page.

www.wetestit.com/wax.htm, "Wax." Internet printout on Jul. 6, 2006, 3 pages.

Improvements Catalong, [Online], [Retrieved on Jan. 11, 2005], Retrieved from the Internet: http://www.improvementscatalog.com/Parent.asp?product=240717x&dept%5Fid=300 &subdept%5Fid=304>.

World Flame Catalog, [Online], [Retrieved on Jan. 11, 2005], Retrieved from the Internet: http://www.golightheworld.com/Store/ProductJCategoryInfo.aspx?cid=7>.

World Flame Catalog, [Online], [Retrieved on Jan. 11, 2005], Retrieved from the Internet: http://www.golightheworld.com/Store/Product/CategoryInfo.aspx?cid=17>.

Norma Coney, 2000, Lark Books, Deborah Morgenthal, pp. 16, 49-50, & 55-58.

U.S. Appl. No. 13/471,482, filed May 15, 2012, Decker.

U.S. Appl. No. 29/414,605, filed Mar. 1, 2012, Decker.

* cited by examiner

CANDLE HAVING A PLANAR WICK AND METHOD OF AND EQUIPMENT FOR MAKING SAME

CROSS REFERENCE TO RELATED APPLICATIONS

This application is a continuation of U.S. patent application Ser. No. 10/759,508, filed Jan. 15, 2004, which, in turn, is a continuation-in-part of U.S. patent application Ser. No. 10/300,695, filed Nov. 19, 2002, now abandoned, the disclosures of which are incorporated herein by reference in their entireties. This application claims priority to U.S. Provisional Patent Application No. 60/331,898, filed Nov. 19, 2001, the disclosure of which is incorporated herein by reference in its entirety.

BACKGROUND

Historically, candles served a functional purpose, but today they are further used to enhance decoration, aroma and ambiance. References to candles date back to at least 3000 B.C. in Crete and Egypt. Candle making as known today, began in the 13th Century. Candle molding machines were developed in the 15th Century. The braided wick was introduced in 1825. A continuous wicking machine was invented in 1834. Manufactured paraffin was introduced in 1850, providing an alternative to tallow. In 1854 paraffin and stearin were combined to create stronger candles, very similar to those used today. Through the past century, a number of "modern" technical innovations have been introduced to improve candle performance and production. Most of the focus has been towards advancing manufacturing methods (U.S. Pat. Nos. 3,964,858; 4,291,458; 4,830,330; 5,537,989; 5,927,965; 6,228,304), improved wick sustainers (U.S. Pat. Nos. 3,819,342; 4,332,548; 4,818,214; 5,690,484; 5,842,850; 5,961,318; 6,062,847; 6,454,561; 6,508,644), varying waxes formulations (U.S. Pat. Nos. 6,066,329; 6,342,080; 6,562,085; 6,599,334), and improving woven (i.e. braided) wick technology (U.S. Pat. Nos. 3,940,233; 4,790,747; 5,124,200). (The entire contents of all of the patents and other publications mentioned anywhere in this disclosure are hereby incorporated by reference in their entireties.)

Traditionally, a candle is made up of a single or multi combustible, porous core or wick surrounded by a fusible, flammable solid wax or wax-like material, such as absolute or blends of petroleum (paraffin) wax, mineral (montan) wax, synthetic wax (polyethylene or Fischer Tropsch), natural waxes (vegetable or animal) and clear candle waxes or "gels" (ETPA). Prior art shows candle wicks referring to cotton or cotton-like materials (i.e. rayon, nylon, hemp) woven, or braided and with or without a "self-supporting" core material such as metal, paper, cotton, polyethylene fiber or a stiffing agent. When a candle is lit, the heat from the flame melts the solid fuel and the resulting liquid then flows up the wick by capillarity. This liquid is subsequently vaporized, the middle zone of the flame is where the vapor is partially decomposed, and the outer layer is marked by combustion of the vapor and the emission of carbon dioxide, water and other vapors into the atmosphere. The wick is the pivotal component for a candle to burn. Although there have been improvements in candle systems and wicks over the past century, there are still complications, limitations and hazards associated with prior wick technologies.

In August 1997, ASTM Subcommittee F15.45 was formed to address candle fire safety issues and to set safety standards. The frequency of injuries associated with candles approximately doubled from the mid-1980s to the mid-'90s. They also reported that there had been an increase in the number of candle recalls due to fire safety issues, including excessive flames in gel, terra cotta and metal container candles and various other types of wax candles. Candle sales increased 350 percent while injuries and deaths from candle related fires increased from thirteen to forty-two percent. The candle industry and the CPSC are currently working through ASTM to develop the necessary consensus standards to improve candle fire safety. The primary objective in this cooperative effort is to reduce injuries and deaths associated with candle fires.

Although there have not been standardized regulations set forth for candles, testing labs such as FTI/SEA and MTL-ACTS are actively involved in technical evaluations for candles with the National Candle Association (NCA) and/or ASTM. Candle burn testing involves stability, burn time, abnormalities, smoke/flaring, sputter, overflow, re-ignition, flame height, afterglow, external surface temperature (thermocouple), direct flame impingement, pool temperature, carbon deposit and soot emissions. Given that a wick's performance affects all these areas of testing, major improvements and focus must be directed towards advancing wick technology.

Prior candle wicks have been woven or braided for well over the last century. Such conventional wicks are woven from multiple fiber or filamentary yarns. The most commonly used yarn is cotton, although other natural fibers such as rayon, nylon or hemp have also been employed. Braided wicks are produced in various sizes, shapes and constructions to achieve the necessary performance (flame height, wax pool size, self-trimming) and process (stability, self-supporting) requirements. The appropriate wick selection for a particular candle application includes type of weave, core, size (diameter or width) and density of wick. Even though wick selection is confined to braided wicks, there are over a thousand different types of braided wicks from which to choose. Consequently, the vast options of wicks may be a disadvantage to manufacturers or consumers, adding additional costs and time spent sourcing a proper wick. Ultimately, braided wicks still have many limitations.

Limitations include the wick's aesthetic appearance, and limited design and ambiance alternatives. Although there are thousands of different types of wicks available, they all consist of a white or natural colored, single strand woven material. Additionally, braided wicks only emit a silent, vertical flame.

Another limitation with braided wicks is that they do not provide enough capillary flow to optimize the performance of today's candles. When manufacturing a braided wick, increasing the picks per inch will increase the density of the wick (i.e. reduce the yield) and thereby reduce the size of capillaries, thus reducing the potential flame height or burn rate. Conversely, reducing the picks per inch will open the braid and reduce the density of the wick (i.e. increase the yield) and thereby increase the size of capillaries, thus optimizing the flame height or burn rate. However, such an increase in yield and burn rate from conventional braided candle wicks is limited by the fact that creating a more open structure with large capillaries creates a less stable wick which changes in characteristics when subjected to the tensions of the candle manufacturing process. In addition, the smooth surface of a braid reduces the functional surface area. The small capillaries and smooth functional surface area of the braided wick make it more difficult to create the required capillary flow rate in today's natural and gel waxes as well as candles that have high amounts of additives to modify a candle's hardness, color, burn rate and aroma (i.e. stearic acid, UV inhibitors, polyethylene, scent oils and color pigments).

Furthermore, today's candles come in different shapes, sizes, and types (i.e. filled, freestanding, taper, tealight and votive), ensuing a need for advanced wick materials and structures.

With the succession of oversized and oddly shaped candles (opposed to the traditional cylinder shapes), larger wax pool size and consumption are preferred. Due to wick height standardization by ASTM (i.e. three inches), braided wicks are limited in size and density, thus resulting in limitations in wax pool size, burn rate and consumption. For example, the thicker a cylindrical wick is, the higher its flame height. And flat wicks are restricted in width (i.e. {fraction (1/32)}-{fraction (1/4)} inch) due to the unsupported nature of a braided wick. Even if a "core" or stiffing agent were applied, the wick still remains too flexible. The wider and thicker the braided wick is the more unstable and hazardous it may be. Since the size of the wax pool is related to the burn rate and flame height, braided wicks typically cannot produce a large enough wax pool to consume the majority of a larger candle without compromising the standardized flame height. Characteristically, a braided wick can produce up to a three-inch diameter wax pool while maintaining a three-inch flame height.

A traditional six-inch diameter candle requires three braided wicks to maximize consumption. This results in additional manufacturing costs, irregular wax pools and potential hazards. For instance, when one wax pool spills into another, the leaking wax may create unstable flame heights and wick drowning.

Prior art shows the need to improve wick technology that allows the wick to burn for a longer period of time and consume more wax than existing wicking material. This was addressed in U.S. Pat. No. 4,790,747, whose wick comprises a single strand of tufted wire coil having a polyethylene and wax coating. One end of the coil is turned upward into a vertical section to form the lighting element and the other end of the wire is wound into a circular base such that it touches the base of the vertical section. Consequently, the wire core technology is manufactured with braided cotton or cotton-like material, generating the same analogous performance complications as disclosed.

One category of braided wicks is "self-trimming" or flat wicks (i.e. wicks that curl or bend to the outside of the flame). Although "self-trimming" wicks may reduce afterglow, they may curl to the point where the terminal ends bend into the wax pool or continue to curl into a spiral curl. This undesirable result can cause a self-trimming braided wick to increase in length so as to increase the amount of wick material, or functional surface area, above the melted wax pool, thereby producing a continually increasing (i.e. unstable) flame height and wax pool. Conversely, it is important that a wick does not over-curl or bend to the point were the wick end touches the wax pool, causing the wick to extinguish and drown in molten wax. Consequently to re-ignite the candle, the wick needs to be located and "dug out" since the wax may cool and harden over the wick. The flat wicks are unsupported and very flexible.

The alternative category of braided wicks is "self-supporting" wicks. Self-supporting wicks (i.e. "cored wicks") are typically round in profile and use paper, cotton, metal or polyethylene fiber material in the core of the braid to stiffen the wick. Additionally, a stiffening agent such as wax-insoluble polymer or copolymer that depolymerizes or pyrolyzes may be used to support a flaccid wick. Although many core or stiffing devices are used, braided wicks remain flexible.

Due to the flexibility in supported or unsupported woven wicks, several hazards can occur. The majority of household candle fires are the result of a candle wick leaning to one side or another in filled or freestanding candles. Filled candles with flexible wicks, particularly those enclosed in plastic or glass containers, may overheat or contact the side of the container, causing breakage or other damage. Additionally, unsupported wicks may extinguish themselves, falling into the pool of molten wax. Further, freestanding candles with an unsupported wick may incur wax spillage due to a decentralized or irregular shaped wax pool.

Certain "self-supporting" wicks may consist of toxic core materials. In April 2003, the Consumer Product Safety Commission (CPSC) banned the manufacture and sale of lead-cored wicks and candles with lead-cored wick because they could present a lead poisoning hazard to young children. This ban became effective in October 2003. The federal ban applies to all domestic and imported candles and will allow the CPSC to seek penalties for violations of the ban. Unfortunately, it is very difficult for consumers to tell if the braided "cored wicks" contain lead.

An additional obstacle with prior art wicks involves keeping a braided candle wick trimmed to a ¼ inch length for proper burning, as recommended by ASTM, NCA and most candle manufacturers and testing labs. If a braided wick is not trimmed properly, carbon balls, excessive soot emissions and fire hazards may occur. Candle manufacturers are not required and usually do not distribute a finished candle with a recommended wick size of ¼ inch.

Also, due to the nature of cotton-like material and especially "self-supporting" core material, a cutting device is needed to trim the braided wick. If a wick is positioned deep in a narrow candle jar or container, it may become difficult for conventional scissors or cutting device to trim off the excess long wick from the candle. Still, another problem is the difficulty to accurately measure a wick to the exact recommended {fraction (1/4)} inch length.

The primary obstruction of prior candle wicks is the emanation of excessive soot developments, resulting in smoke emission and carbon build up. Excessive soot occurs when a candle is burning as a result of the remains of carbon particles that have not been completely decomposed (burned) within the candle flame. Soot will either fully combust and burn off, released into the atmosphere as smoke, or grow into a carbon head or ball, otherwise known as "mushrooming" or "afterglow". Furthermore, carbon heads can detach from the wick and fall into the pool of liquid fuel, where they accumulate. In addition to creating a polluted looking candle, the liquid fuel may combust, thereby igniting the carbon heads, which become hot enough to vaporize and re-ignite resulting in "flashover." In freestanding candles, the carbon heads may heat up the wax and burn through the sides and bottom of the candle causing severe damage and fire hazards. In addition, the development of carbon heads (i.e. "afterglow") causes the emission of unwanted smoke or toxic fumes to linger for several minutes after being extinguished.

As a result of an increase in safety requirements and environmental issues, a Smoke Test Method Task Group, formed by ASTM, developed a method to assess the propensity of a candle to smoke. Candle manufacturers and testing labs can use a simple test to measure the smoke from a candle while it is burning that allows them to improve the performance of that candle. The standard test method was recently balloted in January 2003, and the task group will continue to work toward a final standard based on the ballot results.

In today's candles a wick sustainer is primarily used to provide lateral support to a wick in a candle to hold the wick in place during pouring of the wax-like material in a container or mold or to laterally support the wick when the hardened wax liquefies, no longer supporting the braided wick. During the manufacturing of filled candles the wick is usually centrally positioned in the bottom of a container with an adhesive to seal the wick sustainer to the bottom. Many wick sustainers are difficult though to position centrally. Additionally, many wick sustainers are made of materials that are not heat resistant or have "self-extinguish" qualities resulting in the overheating of glass causing severe damage, such as by fracturing or cracking. Furthermore, the design of a wick sustain can either amplify or reduce the risk of "flashover." A variety of wick holders for braided wick technology have been designed over the past decade or so to reduce fire hazards and increase safety. See, e.g., U.S. Pat. Nos. 1,226,850; 1,267,968; 1,309,545; 1,320,109; 1,344,446; 1,505,092; 2,291,067; 2,324,753; 3,462,235; 3,998,922; and 4,381,914.

It is known in the art to manufacture "freestanding" candles by molding, and wherein a candle body is molded by casting the wax in a mold having a wick inserted therein. Maintaining the wicks centrally in the mold during such operation is a rather difficult procedure, due to the flexibility of braided wicks. For example, as molten wax cools, it shrinks, causing wick repositioning, which increases the risk of wax spillage as the candle burns.

SUMMARY

Directed to overcoming the foregoing and other shortcomings and drawbacks of candle wicks and systems heretofore known, the present invention embodies a planar wick and the method and equipment to produce the same. In preferred forms, the present invention includes wood, wood-like or semi-wood wicks that provide improved capillary flow as well as increase the functional surface area. This candle wick provides additional decoration and an acoustic release. In accordance with principles of the present invention, a candle wick is provided which is particularly designed to burn efficiently in a candle system without producing undesirable smoke and carbon heading. In addition, the wicks are capable of creating a more stable and uniform wax pool diameter. The candle wick is designed to change the physical shape of the flame to thereby provide maximum burning efficiency. Candles of the present invention provide a safer, cleaner burning, decorative, multi-sensory alternative to the prior wick technology.

The present invention provides a candle having a body of a meltable fuel and a planar wick. The meltable fuel can be vegetable-based, paraffin, beeswax, carnauba, candelillia, polymers, polyolesters or other "fuels" as would be apparent to those skilled in the art from this disclosure. When the wick is lit, the candle provides a unique flame formation, usable in a variety of decorative applications. The wick can be configured to evenly deplete the meltable fuel, while allowing for candles having relatively large and unique body configurations. Optionally, the body of candle and/or the wick may include scented oil to promote the release of fragrance upon heating and the wick may comprise wood, thereby providing an acoustic contribution to ambiance, improved combustion that generates less soot than conventional candles.

It is recognized in the analysis of wood that a species or genus or a complete botanical affinity or family name is given. Each species is typically described in terms of its trade, distribution, tree and wood characteristics, including weight, gravity, drying and shrinkage, durability, preservation and toxicity. Wood species are broken down into hardwoods, softwood and tropical woods. There are over 160,000 hardwoods and over 100,000 softwoods available. If anatomical elements are large and irregular, the wood is described as having coarse and uneven texture. If these same features are small and evenly distributed, the texture is fine and uniform. Grain defines the arrangement or alignment of wood tissue; straight, spiral or interlocked. The durability, decay and drying and shrinkage qualities will also effect a wick's function.

The key factors in determining an ideal wood species for the use in a candle embodiment include: a fine to medium, uniform texture for a consistent burn; a generally straight and even, vertical grain; resistance to decay; durability (i.e. minimal shifting due to environmental or climate changes); little tendency to split; shock resistance; strong and stable.

The key factors in determining a wood species for the use in scent dispensing applications, such as for air fresheners and perfume delivery applications include resistance to decay; minimal shrinkage; strong and stable, permeable; and distinctive scents.

In a detailed aspect of a preferred embodiment of the invention, the wick is formed of wood selected from a group consisting of poplar, cherry, maple, wenge, oak, rosewood, and bamboo. The wood can have a moisture content of less than about six percent, or alternatively and preferably between ten and twelve percent. This wick is thereby comprised of a more rigid, viscous material that can produce a larger wax pool and longer burn rate without compromising the flame height.

According to another definition of the present invention a candle having a body of meltable fuel and a planar wick is provided. The wick can be made of wood, semi-wood or wood-like material. The wood can be selected from hardwood, softwood or tropical woods preferably with straight, vertical grains; fine to medium and uniform in texture; medium density; moderate to light weight; low shrinkage; excellent strength and stability and resistant to splitting. The semi-wood may be wood combined with cotton or cotton-like material and wood or wood bonded together with natural adhesives or resins, such as particle board. The wood-like material can be any material natural or manmade lamina, replicating rigid, solid sheet-like material, made from materials such as trees, shrubs, leaves and plant tissue and bark. The woodlike material consists largely of cellulose and lignin with vertical, straight grains and a uniform texture.

The fibrous rigidity of the wick of the present invention provides centralized wax pools, safe burning candles, and no wick drowning or wick bending. The wick is continuously stable while the candle burns and does not lean while the candle is being manufactured.

The wick can be bleached, dyed or printed on such as by printing a message or decorative pattern on the flat surface thereof.

The planar wood, semi-wood, wood-like wick may be dipped or coated with a wax to seal the wick from obstructive elements (i.e. fragrance, dyes, acids, oils or other agents) that may affect the capillary flow, therefore allowing the wick to burn more efficiently and consistently.

The absorbent wood material of the wick can be adapted to be used as wicks in a variety of applications. For example, porosity of the longitudinal exterior surface of a wick can be highly desirable in scent dispensing applications, such as for air fresheners and perfume delivery applications. The length of the wick exposed to air may be controlled to regulate the rate of scent release.

The wick provides an acoustic crackling sound and depending on the combined fuel may emit more or less acoustic sound, as may be desired. Also, the species of wood and amount of viscous sticky substance (i.e. gum or resin) affects the volume of the sound; for example, the Rosaceae family of woods, emit a more acoustic crackling sound due to the integrated gum pockets in the wood.

The wick of the present invention advantageously burns cleanly without producing carbon heads, mushrooming or after glow. Due to the lack of carbon buildup, the wick when extinguished discontinues releasing soot within a minute of being extinguished. (In contrast, today's candles continue to release soot for approximately thirty seconds to five minutes.)

The wick can be trimmed by breaking the burn wick material off with fingers or a cutting device. Typically, the height of the wick above the wax is ⅛ to {fraction (3/16)} inch. It is easier than braided wicks to trim and determine the correct height. The preferred height of the wick when the candle is manufactured and sold is ⅛ to {fraction (3/16)} inch above the wax. The wick holder raises the wick ⅛ to {fraction (3/16)} inch, thus, extending the wick that distance above the wax for proper burning.

The wick can be ⅛ to twenty inches in width depending on the size of the candle container or desired size of the free-standing candle. The height correlates to the size of the candle. The wick can be flat or curved vertically.

The wick thickness is determined by the type of wax; vegetable base waxes tend to need thicker wicks compared to petroleum based which is more incendiary. The width is determined by the size of the container verses the thermal flow. For example, a ⅜ inch width wick is typically placed in a three inch diameter petroleum-based pillar, whereas a {fraction (5/16)} inch width wick is placed in a three inch vegetable-based pillar. A four inch round glass container may use a ½ inch width wick with paraffin wax while the same container with vegetable wax may use a {fraction (5/8)} inch width wick.

The present invention wick burns cooler thus causing a longer burn rate, lower external temperature and lower container temperature. This is because the emissions of carbon dioxide, water and other vapors are released and burn up causing cleaner combustion. Since the wick extends horizontally, the candle can consume more wax than a single wick than prior art candles, thereby causing longer burn rate and a larger wax pool.

The wick can be manufactured by cutting a log vertically from 0.019 to 0.30 inch and then laser or die cutting to an exact size for the desired candle system. Alternatively, the wick can be wood or woodlike particulars or particulated adhered or bonded together with a bonding material, pressed and cut to size. The candle can have a wick sustainer or holder, and the candle can be made of a fuel capable of melting to form a liquid pool and traveling by capillary action to a flame burning on the wick.

The wood may be from a family of hardwoods, softwood or tropical woods. The preferred wood qualities are: fine to medium, uniform texture, straight, even vertical grain, high to medium density and strength, light to medium weight and shock and split resistant. Preferred wood species or genus include but are not limited to: Adler, Cedar, Cherry, Cypress, Poplar, Silverbell, Spruce, Rimo, and Pillarwood. Cherry and Poplar are the most abundant and commercially available in the United States. Additional preferred species or genus of wood include: Aspen, Basswood, Beech, Birch, Hard Maple, Pacific Yew, Pine and Witch Hazel, due to their fine to medium, uniform texture; and straight, vertical grain as listed above, although these wood families tend to be heavier, denser and softer.

The present invention further relates generally to the field of candle making and in particular to a new and useful sustainer for a planar wick which extinguishes the candle flame and inhibits combustion of residual candle fuel in a container or freestanding for the candle at the end of the candle useful life. The present invention thus advantageously provides for a stable wick construction that improves candle safety and performance by centering the wick and remaining upright.

In another detailed aspect of a preferred embodiment of the invention, the candle further includes a wick holder having a base and a support for receiving the planar wick. Optionally, the wick holder is configured to hold a planar wick upright independent of the body.

In a method of manufacture, a planar wick supported by a wick holder is positioned within a mold and, thereafter, material of the body is poured into the mold. Once the material sets, the candle can be removed from the mold.

The wick holder can comprise a body having a top surface, bottom surface, a pair of upper walls connected to the top and bottom surfaces and a planer bore for receiving the wick passing through the two upper walls. A barrier extends horizontally through the side walls. And the barrier and body are made from noncombustible materials. The upper walls are preferably at least a half inch in height above the bottom of the candle. The raised wick holder is preferably the central position through the body for receiving a wick. The body is preferably {fraction (1/16)} to {fraction (1/8)} inch but it may be cylindrical, pyramid shapes, cube shaped or conical. The diameter is in direct correlation to the size of the diameter of the bottom of the candle or candle holder/container. This keeps the wick always centrally located.

The wick holder of the present invention differs from prior art wick holders in the following ways: it is designed to center and hold upright a planar wick, and it is easily inserted into a slit, between two flat walls which hold the wick upright. There is a centering line on the wick sustain to center the wick.

Another invention disclosed herein thus relates to a flame retardant wick holder and anti-flash wick support for a candle wick in a candle to additionally minimize the risk of flashover. Using a wick sustain to elevate the exposed portion of the bottom end of a wick from a supporting surface cuts the wick off from the fuel pool once the pool level drops below that portion of the wick, thereby extinguishing the candle and retaining a fuel pool on the supporting surface. This insures that a minimum melt pool remains throughout the lifetime of the candle, and also helps to keep extraneous material away from the flame. In other words, in addition to extinguishing the candle, elevating the wick also separates the primary flame from the extraneous material in the fuel pool as the pool lowers.

The wick holder or sustain can be made from polymers or ceramics and preferably polyethersulfone (PES) with a thickness of {fraction (1/32)} inch and which is noncombustible and intumescent when heated, to assist in self-extinguishing and reducing the heat transferred from the wick sustain to the supporting surface.

The candle can be manufactured by positioning an elongate member in a desired wick location in a candle mold. The elongate member has the same width and thickness dimensions as the wick to be used. With the elongate member in position the molten wax is poured into the mold around the member. The wax is allowed to solidify and the member then pulled out, leaving (or forming) an elongate slot centered in the wax. The thin planar, substantial rigid wood or wood product wick is then inserted into the straight slot. The end of the wick is inserted into the retaining slot of a wick sustain device press fit into the bottom surface of the candle.

To manufacture a candle, a centering device of the present invention for planar wicks provides an improved apparatus and method for preparing and installing wicking in free-standing candle bodies and comprises in its preferred arrangement a station for forming a passageway in a formed candle body to maintain the wick centrally in the mold during such operation. The centering device can be manufactured in metal, polymers or ceramic, preferably polyethersulfane (PES) with a thickness of {fraction (1/32)} inch or applied to and included in these mold compounds polyvinyl chloride, latex systems, silicon rubber systems, polysulfide rubber systems and polyurethane flexible mold compounds.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
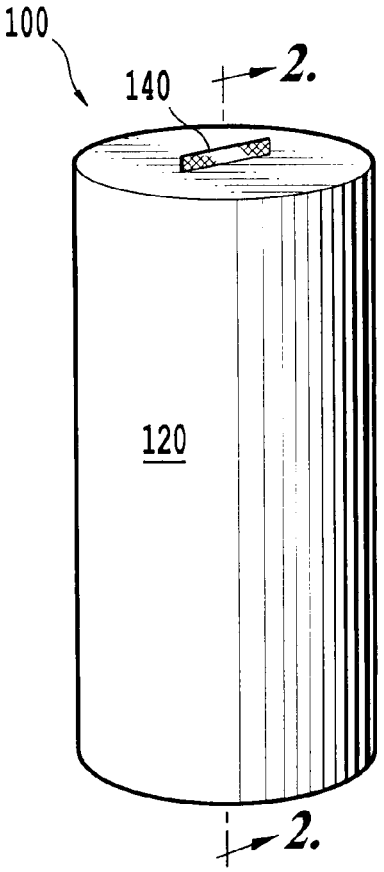
FIG. 1 is a perspective view of a candle in accordance with the present invention, the candle having a planar wick.

With reference to the illustrative drawings, and particularly to FIG. 1, there is shown a candle shown generally at 100 having a body 120 of a meltable fuel and a planar wick 140. When lit, the candle 100 provides a unique flame formation usable in a variety of decorative applications. Optionally, the candle body 120 and/or the wick 140 may include scented oil to promote the release of fragrance upon heating, may be bleached, dyed or printed on for decor, and can be configured to provide an acoustic contribution to ambiance.

The material and thickness of the wick 140 are selected to promote the candle's functionality as well as the candle's contributions to ambiance. In a presently preferred embodiment, the wick 140 is made of wood, semi-wood or wood-like material and, when lit, provides a pleasant crackling sound and burns more thoroughly with less carbon heading and sooting than conventional wicks. Processed wood materials such as particleboard and fiberboard may also be used. Overall, woods having relatively straight, condensed grains and without checking make effective wicks. In contrast to traditional wicks, which require periodic trimming, maintenance of wood wicks can be performed with or without any tools. Rather, burned edges of wood wicks can be removed with the user's fingers, before relighting.

Empirical testing has shown that woods such as poplar, cherry, maple, wenge, oak, rosewood, and bamboo are effective with both paraffin-based and vegetable oil-based waxes, and are effective when used in conjunction with waxes having melting points between one hundred and ten degrees and one hundred and ninety degrees Fahrenheit. For example, a wick formed of cherry wood having a thickness between {fraction (1/53)} inch and {fraction (1/8)} inch, used in a body of a paraffin or vegetable oil-based wax provides an even burn and a pleasant crackling sound. Hard non-brittle, tight grain woods work best. And cherry is preferred over other species of wood for some applications because its higher oil content gives it more of a desirable crackling sound when burning. Although testing has shown that some woods, such as walnut, ash, birch, pearwood, sapele, pommele, zebrawood, lacewood, mahogany, pine, teak, ebony, and various burls, are not as effective, these woods are still within the scope of the invention. Woods having a moisture level of less than about six percent have been found to work, but moisture contents of between ten and twelve percent are preferred.

The wick 140 can have thicknesses of 0.019-0.028 inch, and widths of 1/8 to three inches are the safest. The wick height depends on the candle height and for example can be 1/2 inch to six feet. Wick dimensions can relate to the type of wax used. While wicks for paraffin candles will be thinner and narrower (approximately 0.019-0.023 inch), wicks for vegetable-based waxes will be thicker (approximately 0.023-0.028 inch). Palm and soy are the main components of vegetable-based waxes. It is also within the scope of the invention to use a paraffin-vegetable-based wax mixture. The wax, fragrance and dye used can all affect the desired wick dimensions. However, as an example for a three-inch diameter candle, a 3/8-{fraction (5/8)} inch wide wick can be used.

One way of forming the wood wicks is to have traditional manufacturers of wood veneers for doors, windows and the like, cut the veneers in a certain way. They are then die cut to a specific size, and pressed and dried as needed, since if the wood wick is too moist it may not produce a consistent flame. A moisture content of eight to twenty percent is preferred.

Figure 16:
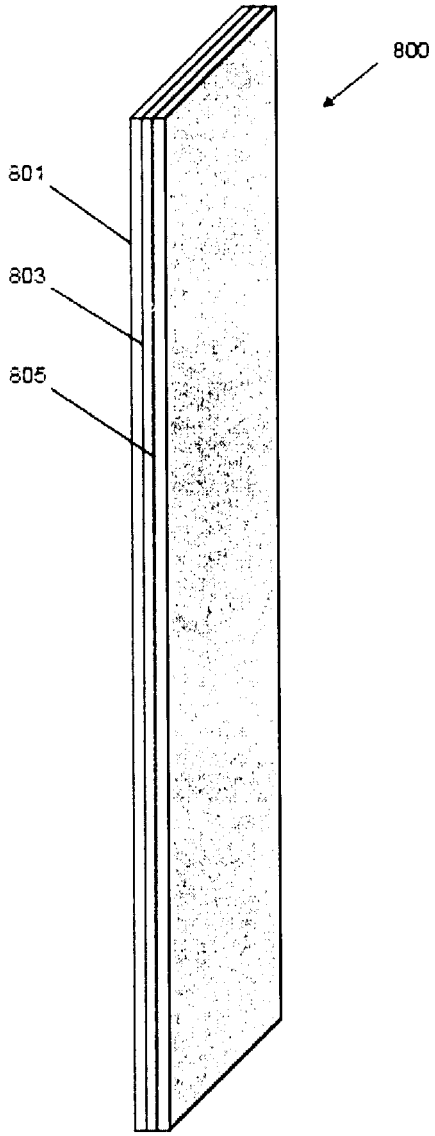
FIG. 16 is a schematic perspective view of exemplary wick according to the present invention.

Cotton or cotton-like materials can be incorporated into the wood wick construction. An exemplary wick 800, as shown in FIG. 16, is prepared by sandwiching a piece of cotton 803 between the sheets of wood 801, 805 and sealing the sandwiched construction with wax. Another example is to make a wood particle/powder fiberboard with small bits of cotton incorporated therein.

Figure 5:
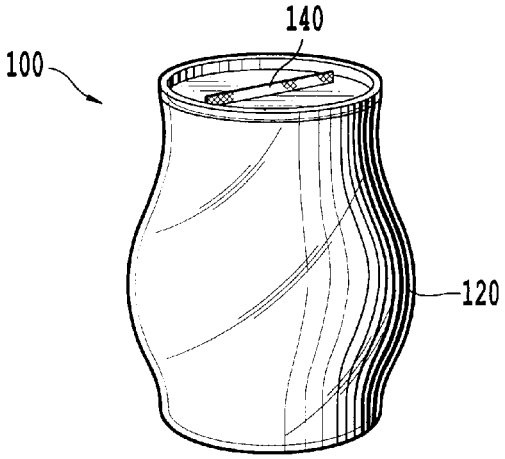
FIG. 5 is a perspective view of another preferred embodiment of a candle in accordance with the invention, depicting a body having an asymmetric configuration.
Figure 6:
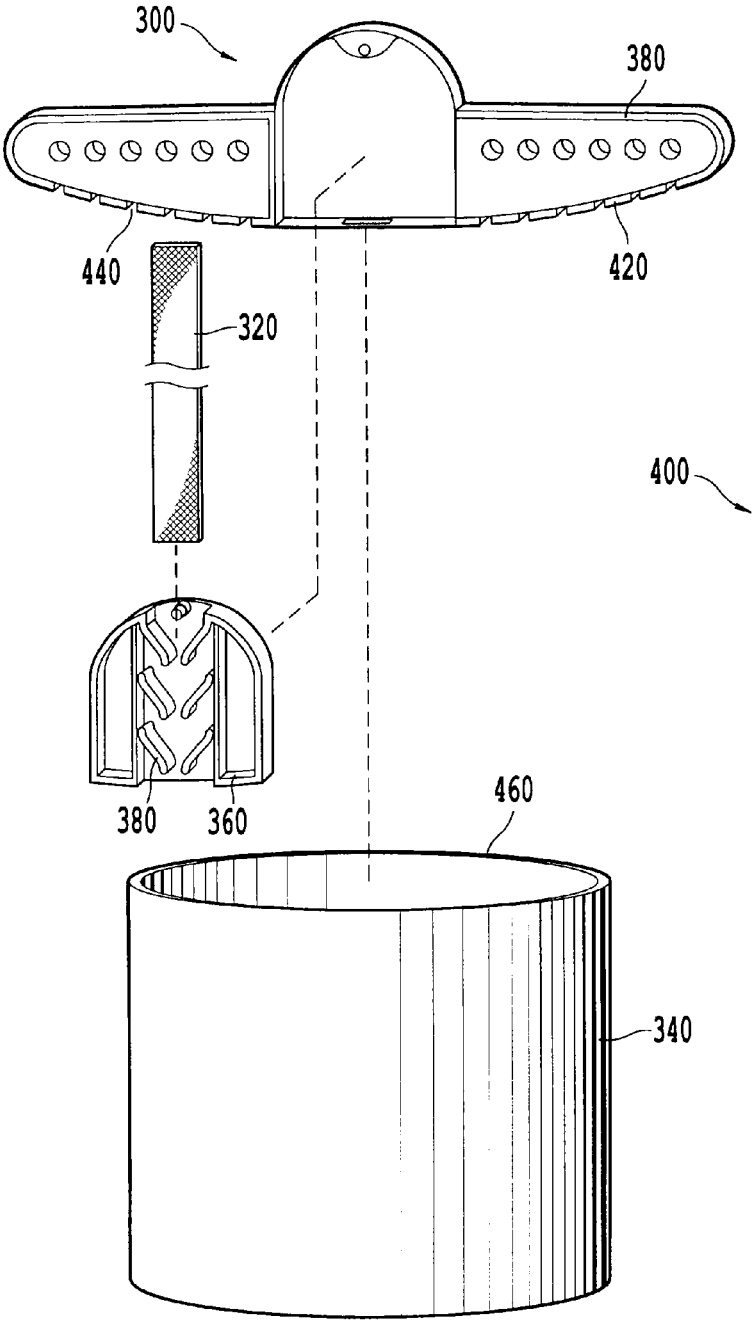
FIG. 6 is an exploded view showing candle-making equipment of the present invention.
Figure 17:
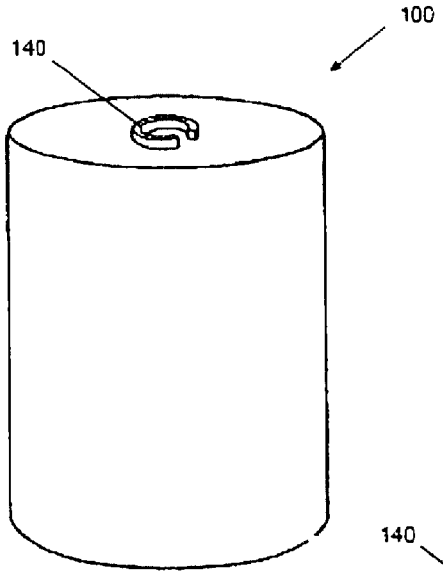
FIG. 17 is a schematic perspective view of exemplary candle according to the present invention.
Figure 18:
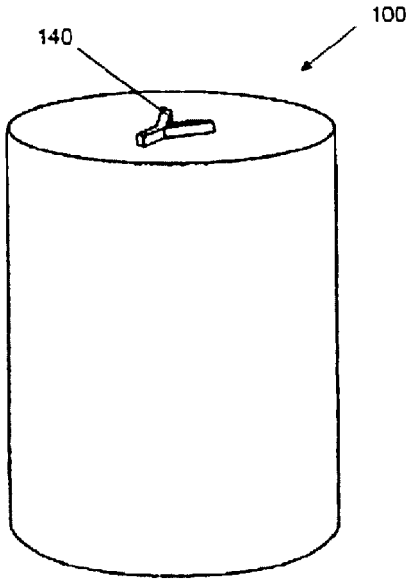
FIG. 18 is a schematic perspective view of exemplary candle according to the present invention.
Figure 19:
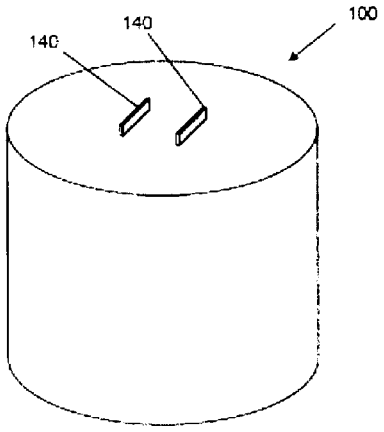
FIG. 19 is a schematic perspective view of exemplary candle according to the present invention.
Figure 20:
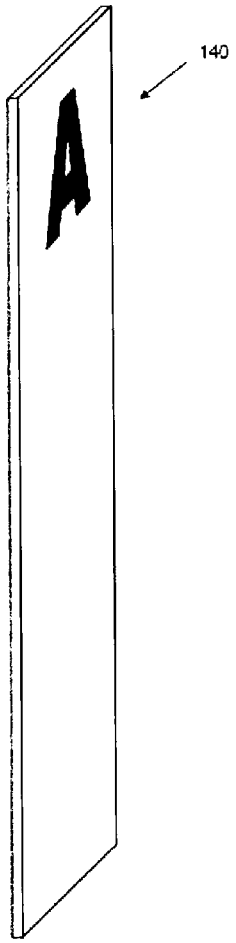
FIG. 20 is a schematic perspective view of exemplary wick according to the present invention.

With continued reference to FIG. 1, the wick 140 is generally straight, as viewed from above the candle and is relatively thin and pliable. In other embodiments, the wick 140 may be configured in various shapes, bent or straight, as desired and shown in FIGS. 17 and 18. For instance, the wick can be configured, in any decorative shape as viewed from the top, such as an arc, circle, square, triangle, heart, or an alphanumeric shape (e.g., as shown in FIGS. 17 and 18). Also, the size and shape of the wick are selected to provide even depletion of the meltable material throughout the life of the candle 100, even for unique body configurations (see FIG. 5). For example, the wick of a free-standing candle is sized to create a pool of wax that reaches within ⅛ to {fraction (½)} inch from the edge of the body 120. Beneficially, the planar wick 140 allows for a larger candle that depletes evenly. As shown in FIG. 19, each candle 100 can have one or more wicks 120 configured in the shape of a sheet. Optionally, the wick 140 can be soaked in scented oil to promote the release of fragrance when burning, or can be bleached, dyed and printed on (as shown in FIG. 20) for decor.

Figure 2:
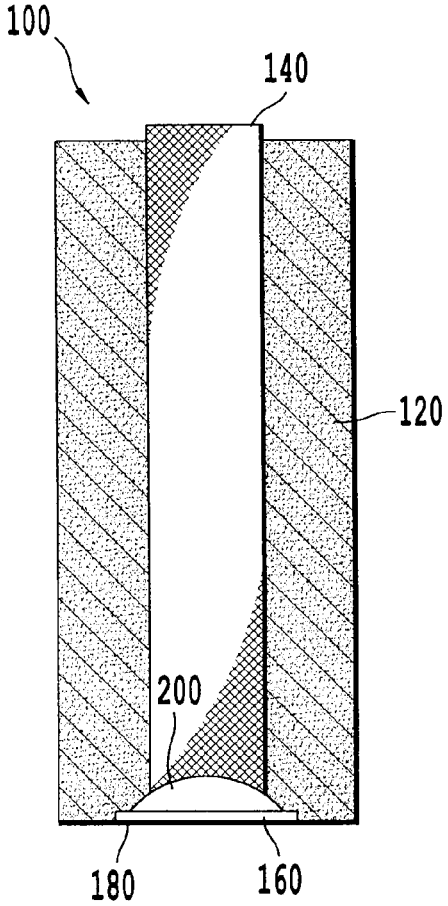
FIG. 2 is a cross-section view taken on line 2-2 of FIG. 1, the candle having a wick holder.
Figure 3:
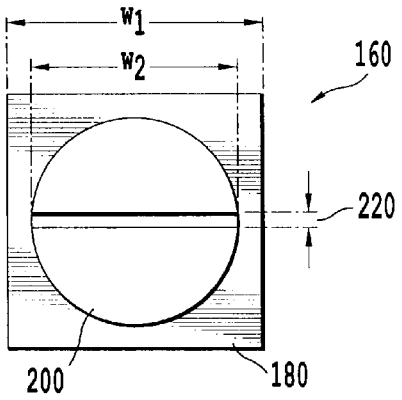
FIG. 3 is a plan view of the wick holder of the candle of FIG. 1.

Referring now to FIGS. 2 and 3, the candle 100 further includes a wick holder 160 that aids both in the manufacture and use of the candle. The wick holder has a base 180 and a support 200 for receiving the wick. The wick holder can be configured to hold a wood wick upright independent of the body 120. In this embodiment, the base 180 has a width W1 of about 0.05 inch and the support 200 has a width W2 of about 0.09 inch. The support defines a spacing 220 of about 0.02 inch for receiving the wick.

Figure 4:
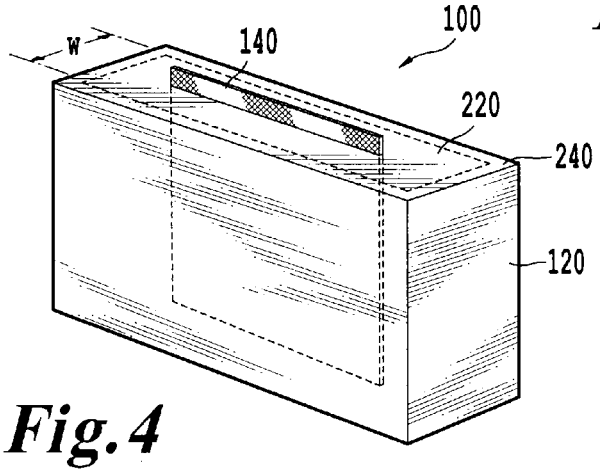
FIG. 4 is a cross-sectional view of another preferred embodiment of a candle in accordance with the invention, depicting a body having zones of different melting points.

With reference now to FIG. 4, the body 120 can be formed to have regions with different melting points. In this embodiment, the body has an inner core 220 of a first melting point and an outer core 240 of a second melting point. The inner core melting point may be in the region of two hundred to two hundred and forty degrees Fahrenheit, and the external region melting point may be between one hundred and twenty and one hundred and sixty degrees Fahrenheit. Although, the preferred melting point of inner core is between one hundred and forty to one hundred and sixty degrees Fahrenheit and the outer core is between one hundred and twenty-five and one hundred and thirty-five degrees Fahrenheit. This may avoid the external appearance of cracks in the candle. In a preferred embodiment, the inner core 220 has a width W of at least 1.5 inches to ensure that the heat of the wick 120 does not promote the fast melting of the external region 140. The external region may have a thickness of at least one inch.

The wick 120 should be positioned accurately in the desired location. If it leans to one side on the other as can occur by the tension of the cooling wax, the candle 100 will burn unevenly. To ensure an accurate positioning of the wick 120, unique equipment and manufacturing method have been developed. And the equipment and method can best be understood from FIGS. 6-10, and the discussion below.

Figure 7:
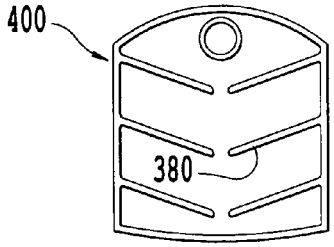
FIG. 7 is a front view of an alternative holding device of the equipment of FIG. 6.

Referring thereto it is seen that a centering device 300 is provided which centers an elongate member 320, a flat metal, ceramic or plastic rod, in the candle mold 340. More specifically, the holding device, piece 360 is snap fit via a button in the middle of the centering arms (or wings) 380 to form the centering device 300. The elongate member 320 is inserted down into the holding device 360 and held in place by its resilient fingers 300. The fingers 380 can accommodate elongate members (and thus subsequently wicks) of different widths. An alternative holding device construction is shown in FIG. 7 generally at 400.

Figure 8:
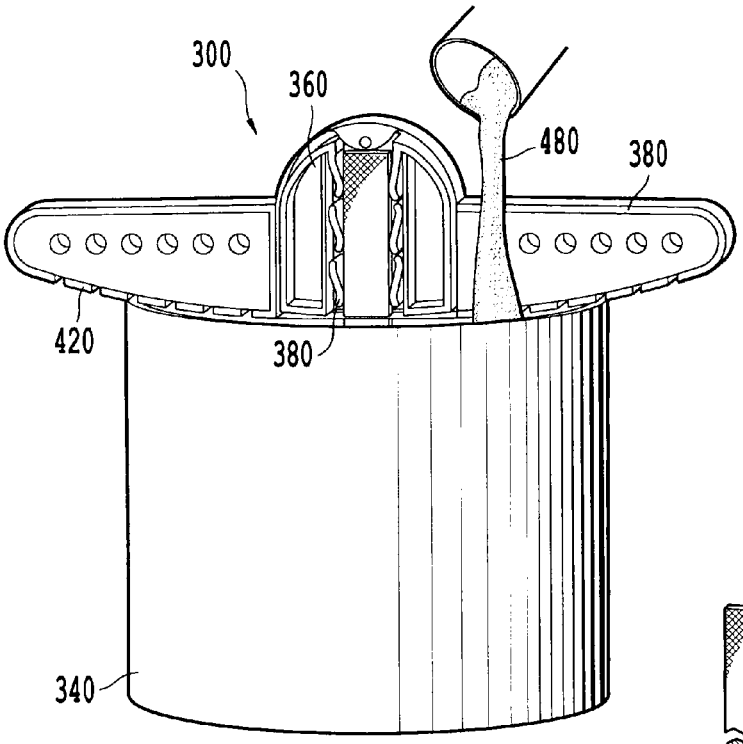
FIG. 8 shows a first process step using the assembled equipment of FIG. 8.

On bottom surfaces of the centering arms are a plurality of protrusions, 420 having the same size and spacing on both sides. The protrusions define grooves 440 for fitting onto the rims 460 of molds 346, as can be seen in FIG. 8. The different spaced grooves 440 allow the centering device 300 to be placed on molds 340 of different diameters and still accurately hold and center the elongate member 320 in the mold.

Figure 9:
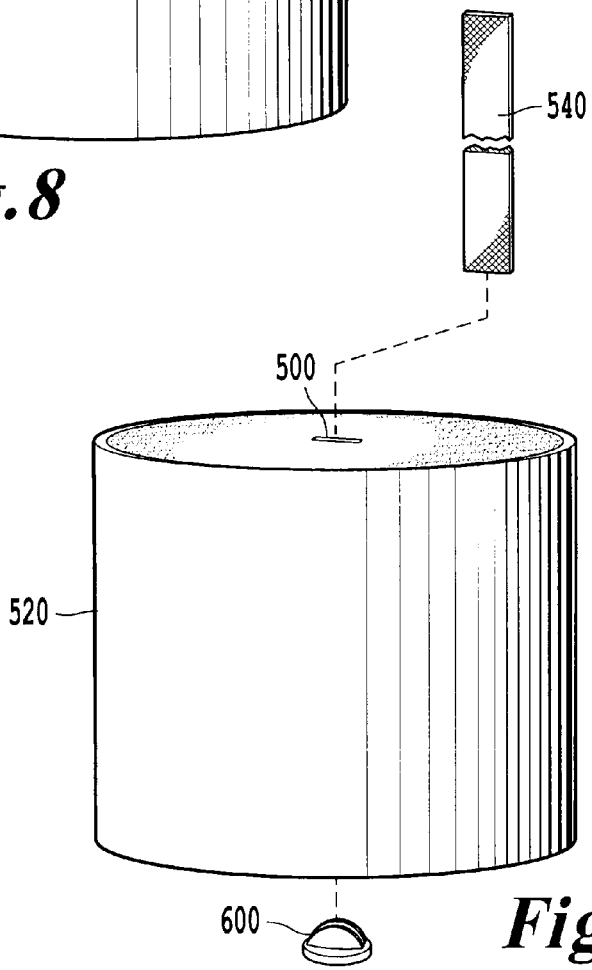
FIG. 9 shows a second process step of the present invention.

With the centering device 300 in place on the mold 340 and the elongate member (flat rod) 320 centered in the mold as shown in FIG. 8, the desired amount of molten wax 480 is poured into the metal or polyethylene mold 340 around the elongate member 320. The wax 480 is allowed to solidify (which can typically take at least two hours to solidify in a small candle and up to twenty-four hours in a large candle, depending on the type of wax and wax ingredients), and the elongate member 320 pulled out to define a slot 500 in the solidified wax 520, as illustrated in FIG. 9, where the wax is shown removed from the mold. The wick 540 (140) can be dipped or coated with wax before being inserted into the slot 500. This seals the wick 540 so that the dyes and fragrances of the candle wax 540 will not be absorbed into the (porous) wick.

Figure 10:
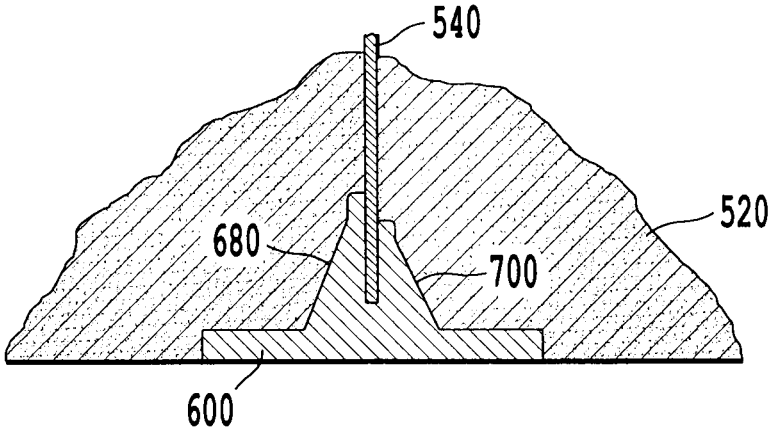
FIG. 10 is an enlarged sectional view showing the wick sustain device of FIG. 9 in position in the candle.
Figure 11:
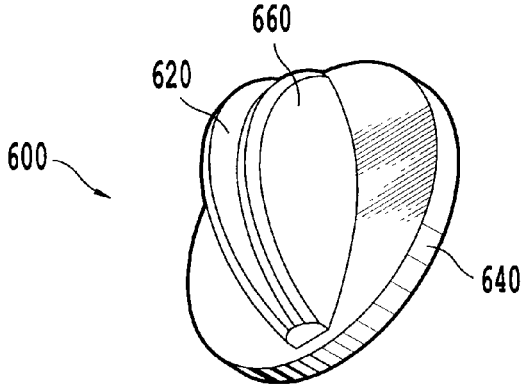
FIG. 11 is a perspective view of the wick sustain device of FIGS. 9 and 10 illustrated in isolation.
Figure 12:
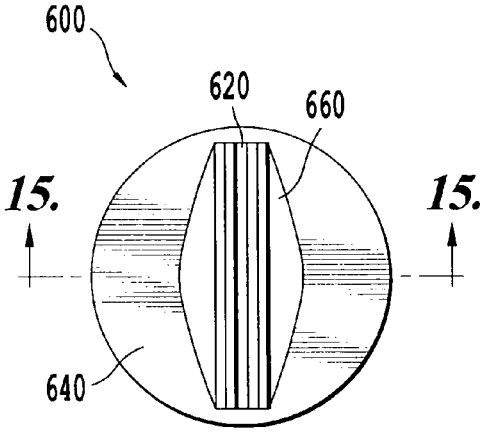
FIG. 12 is a top view thereof.
Figure 13:
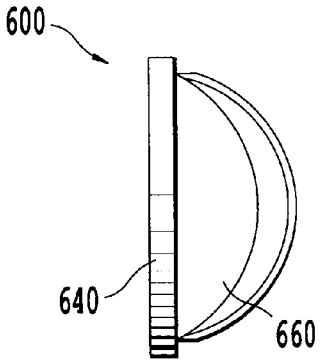
FIG. 13 is a side view thereof.
Figure 14:
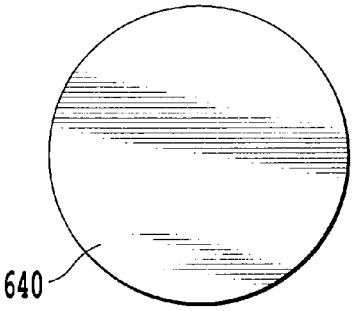
FIG. 14 is a bottom view thereof.
Figure 15:
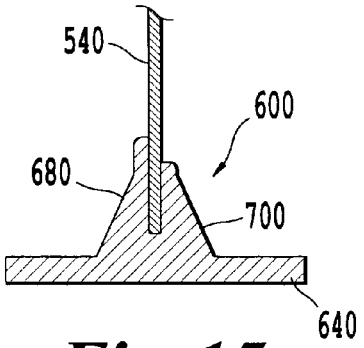
FIG. 15 is a cross-sectional view taken on line 15-15 of FIG. 12.

A wick sustain device 600 is press fit into the bottom of the candle with the slot 620 thereof aligned with the candle slot 500 and a label (not shown) can be applied to the candle bottom over the bottom of the wick sustain device 600. The ("planar wick") wick 540 is inserted into the slot 500 in the wax down into the slot 620 of the wick sustain device 600, as illustrated in FIG. 10. The wick 540 is thereby consistently straight and accurately positioned. When the candle burns down to a short height, the wick sustain device 600 holds the wick 540 up. The wick 540 should initially extend up between {fraction (1/16)} to {fraction (1/4)} inch, and preferably ⅛ or {fraction (3/16)} inch, above the top surface of the candle. If it is too tall, the flame is too high. If it is too short, it is difficult to light. When relighting it, the burnt ash should be removed by hand so that the wood wick 150 extends up about {fraction (3/16)} inch.

The wick sustain device 600 is shown in isolation in FIGS. 11-15. It is seen to include a round base member 640 and structure 660 secured thereto and defining the upwardly facing wick-receiving slot 620. The structure is essentially two spaced plates 680, 700, one taller than the other so that the wick is easier to install and is held straight upright. The slot 620 is 0.5 inch long, 1.5 inch wide, and 0.35 inch deep, but not limited to these proportions or dimensions. The base member 640 can have a diameter of two inches.

With the wick 540 in place, a finishing step—a topping off—can be conducted. Additional wax can be poured on top of the candle and a heat gun used to smooth it out and put a glaze on it.

Standard cotton wick candles have a tall flame height and a small pool size. So for larger candles, more cotton wicks are used for a single candle. This creates inconsistent wax pool and flame height and does not efficiently use the candle. Thus, with the present invention a single longer wick 540 (e.g., 1¼ inches for a six inch candle), with a safe flame height, can be used. Due to a cooler burn the candle lasts longer.

It should be appreciated from the foregoing description that the present invention provides candles usable in a variety of decorative applications and having unique flame formations. Optionally, the candle may include scented oil to promote the release of fragrance upon heating and the wick can be made of wood, semi-wood or wood-like material with a straight, vertical grain to provide an acoustic contribution to ambiance when lit. The present invention thus provides a candle having improved combustion, that provides a unique flame formation, that has a wick that is safer, remains rigid throughout its use, improves combustion and that makes an acoustic contribution to ambiance.

From the foregoing detailed description, it will be evident that there are a number of changes, adaptations and modifications of the present invention which come within the province of those skilled in the art. The scope of the invention includes any combination of the elements from the different species or embodiments disclosed herein, as well as subassemblies, assemblies, and methods thereof. However, it is intended that all such variations not departing from the spirit of the invention be considered as within the scope thereof.

The invention claimed is:

1. A candle, comprising:
a solid planar wick;
a body of meltable fuel; and
a wick holder;
wherein:
the wick holder comprises:
a planar base member having a top surface and a bottom surface; and
two separate substantially vertical plates extending from the top surface of the planar base, the vertical plates being spaced apart to accommodate the solid planar wick;
the solid planar wick is held in an upright position by the wick holder;
a portion of the solid planar wick extends above a top surface of the body of meltable fuel;
an entirety of the wick holder is below the top surface the body of meltable fuel;
the solid planar wick has a height dimension, a width dimension, and a thickness dimension;
the height dimension is greater than the width dimension and extends from a base of the candle to a top surface of the body of meltable fuel;
the width dimension is greater than the thickness dimension;
the thickness dimension is from 0.018 to 0.23 inches;
the solid planar wick comprises cellulose and lignin;
the solid planar wick comprises generally straight grains extending substantially in the height dimension; and
the candle emits an acoustic crackling sound when lit.

2. The candle of claim 1, wherein the solid planar wick comprises at least one fibrous material.

3. The candle of claim 2, wherein the at least one fibrous material comprises cotton.

4. The candle of claim 1, wherein the solid planar wick has a moisture content of from 6 to 8 percent.

5. The candle of claim 1, wherein the solid planar wick comprises:
a sheet of a material selected from the group consisting of wood, wood product, a semi-wood composition, and a wood-like material; and
a flat piece of cotton.

6. The candle of claim 1, wherein the meltable fuel comprises at least one member selected from the group consisting of beeswax, carnauba wax, candelilla wax and vegetable-based waxes.

7. The candle of claim 1, wherein the meltable fuel comprises at least one member selected from the group consisting of petroleum-based waxes and synthetic waxes.

8. The candle of claim 1, wherein the meltable fuel comprises at least one additional component selected from the group consisting of fragrances and dyes.

9. The candle of claim 1, wherein the solid planar wick extends above the body of meltable fuel in an amount of from 1/16 to 1/4 inches.

10. The candle of claim 1, wherein the solid planar wick extends above the body of meltable fuel in an amount of from 1/8 to 3/16 inches.

11. The candle of claim 1, wherein the solid planar wick is coated with wax.

12. The candle of claim 1, wherein the solid planar wick has been subjected to at least one treatment selected from the group consisting of bleaching, dyeing and printing.

13. The candle of claim 1, comprising multiple solid planar wicks.

14. The candle of claim 1, wherein the solid planar wick comprises a curved portion when viewed from above.

15. The candle of claim 13, wherein the multiple solid planar wicks differ in dimension.

16. The candle of claim 1, wherein the solid planar wick is configured so that, when viewed from above, the solid planar wick has a shape selected from an arc, a circle, a square, a triangle, a heart, and an alphanumeric shape.

17. The candle of claim 1, wherein the solid planar wick is configured so that, when viewed from above, the solid planar wick has a circle shape.

18. The candle of claim 1, wherein the solid planar wick is configured so that, when viewed from above, the solid planar wick has a C-shape.

19. The candle of claim 1, wherein the solid planar wick is configured so that, when viewed from above, the solid planar wick has an O-shape.

20. The candle of claim 1, wherein the solid planar wick is configured so that, when viewed from above, the solid planar wick has an X-shape.

21. The candle of claim 1, wherein the solid planar wick is configured so that, when viewed from above, the solid planar wick has a T-shape.

22. The candle of claim 1, wherein the solid planar wick is configured so that, when viewed from above, the solid planar wick has a V-shape.

23. The candle of claim 1, wherein the solid planar wick comprises wood or wood particles that have been adhered, bonded, or pressed together.

24. The candle of claim 1, wherein the wick comprises wood, semi-wood, or a wood-like material.

25. The candle of claim 1, wherein the solid planar wick comprises a fiberboard material.

26. The candle of claim 1, wherein the solid planar wick comprises two planar members.

27. The candle of claim 26, wherein the solid planar wick comprises two members adhered together.

28. The candle of claim 1, wherein the solid planar wick comprises three planar members.

29. The candle of claim 13, comprising multiple solid planar wicks that comprise multiple layers.

30. The candle of claim 1, wherein the solid planar wick comprises semi-wood that may be wood combined with cotton or cotton-like material.

* * * * *